United States Patent [19]

Jewett

[11] Patent Number: 4,656,684

[45] Date of Patent: Apr. 14, 1987

[54] TANGLE-FREE BLOW-DRY BRUSH

[76] Inventor: John H. Jewett, 4743 Noble Ave., Sherman Oaks, Calif. 91403

[21] Appl. No.: 761,750

[22] Filed: Aug. 1, 1985

[51] Int. Cl.[4] ..... A46B 13/00

[52] U.S. Cl. ..... 15/27; 15/187; 132/33 A; 132/85

[58] Field of Search ..... 15/27, 160, 186, 187, 15/188; 132/9, 11, 33 R, 37 R, 39, 85, 118

[56] References Cited

U.S. PATENT DOCUMENTS

| | | | |
|---|---|---|---|
| 2,545,885 | 3/1951 | Jackson | 132/118 |
| 3,416,543 | 12/1968 | Hantman | 132/11 R X |
| 3,909,868 | 10/1975 | Nogues | 15/27 |
| 4,314,137 | 2/1982 | Dörn | 15/27 X |
| 4,486,915 | 12/1984 | Stewart et al. | 132/37 R |

*Primary Examiner*—Peter Feldman

*Attorney, Agent, or Firm*—Poms, Snith, Lande & Rose

[57] ABSTRACT

A hair stying and grooming implement for use with the hair blow dryer essentially comprises two pieces, a hair engaging member and a handle. The member is mounted on the handle and both are capable of freely rotating along a common longitudinal axis relative to each other. The handle includes a locking means and releasing means which prohibits relative rotational movement between the handle and member and which holds the handle and member in selective rotational orientation or allows free relative rotation, to permit easy disengagement of the brush from the hair. The hair engaging member includes several rows of bristles on a brush holder which untangles the hair and holds the hair in order to wrap it around the body of the member. The member also includes beveled flanges which direct the hair onto the brush as the hair is drawn around the body of the member. In addition, the member includes a plurality of crescent-moon shaped ribs which guide the hair around the body of the member and increase the drying efficiency of the blow dryer. When used in conjunction with the hair blow dryer, the cylindrical shape of the member creates curls in hair which is wrapped around the hair engaging member. The hair engaging member may also include grooves extending around its periphery to help guide the hair.

20 Claims, 7 Drawing Figures

19
20
24
25
28
31
32
42
27
14
15
16
18
43
39
37
36
35
38
30
40
29
41
33

TANGLE-FREE BLOW-DRY BRUSH

FIELD OF THE INVENTION

This invention relates to hair styling and hair grooming implements, and more specifically to such implements which are intended for use with a hair blow dryer.

BACKGROUND OF THE INVENTION

The comb and brush have dominated the history of the hair grooming and styling devices. The latest generation of such implements include revolutionary hair grooming and styling devices which have had a major impact on the hair styling world. One of these innovations is the portable hair blow dryer. This invention virtually replaced the stationary hair salon blow dryers and the household hair dryers that looked liked a combination of a shower cap and a vacuum cleaner. Besides the time saved to dry hair, this hand held invention facilitated the creation of new hair styles and easier re-creation of salon hairstyles at home. In addition, the hair blow dryer prompted the invention of brushes specifically designed for use with a blow dryer. Two such brushes are the round brush and vent brush. With these brushes, in connection with a blow dryer, a beautician or a consumer is able to curl, feather, or add body to the hair. These manipulations were previously virtually impossible when using a conventional brush and comb.

One problem with the round brush is that hair gets caught around the handle when it is used to curl the hair. Another problem when curling the hair with a round brush is that it cannot be easily disengaged from the hair, especially from long hair. Furthermore, the round brush's numerous bristles become entangled with the hair and often the brush must be brutally pulled out and in doing so causes discomfort to the customer or consumer and may make the hair kinky instead of smooth. In addition, if the brush bristles were made out of low temperature softening plastic, they tend to melt or break down after extended exposure to the hot air of the blow dryer.

The vent brush is prone to be susceptible to this latter problem because it is conventionally made out of a plastic. The vent brush has several bristles that are spaced relatively far apart so that the hair will not become entangled in the bristles as it does with the round brush; however, the hair can still become entangled with the vent brush's handle if it is used to curl the hair. Thus, on the one hand, the vent brush doesn't kink the hair like the round brush, but on the other hand, the vent brush cannot curl the hair as effectively as a round brush.

The other revolutionary hair styling device is the modern curling iron. The curling iron curls the hair and essentially does the job that takes a blow dryer and round brush to do. Like the blow dryer, the curling iron virtually replaced its predecessor, hair curlers, and made re-creation of salon hairstyles easier and less time consuming. Of course, the curling iron also facilitated tighter curls, previously unattainable at home or with a comb alone.

The problem with the curling iron is that it can damage the hair if it is improperly used; in fact, a curling iron can literally fry the hair. Moreover, the exposed, electrically heated barrel of the curling iron subjects a consumer to skin burns, and is a danger to children, in general, if the device is mishandled while in use. Furthermore, the curling iron consumes more electrical energy than the blow dryer. Also, some curling irons come with bristles or other similar means which only add the problem of the hair becoming entangled with the device. The problem of the hair becoming entangled with the curling iron handle also exists as a potential problem.

Accordingly, a principal object of the present invention is to avoid the entanglement of the hair with the brush handle when the brush is being used to curl the hair in conjunction with a blow dryer. Another principal object of the present invention is to permit easier disengagement of hair which has been curled around the brush, thereby reducing the kinking effect produced by a round brush.

SUMMARY OF THE INVENTION

In accordance with the present invention, an implement is used in conjunction with a blow dryer, which employs a generally cylindrically shaped member that is rotatable with respect to the handle, to style and groom hair. The member is mounted on the handle and includes a row of bristles which untangles hair and holds the hair in order to curl the hair around the body of the member. The member also includes at least one and preferably two beveled flanges which push the hair toward the middle of the member as the hair is curled around the body of the member. Once the hair is curled around the body of the member and after the hot air of the blow dryer is applied to the hair, the implement is easily disengaged from the hair by simply allowing the member to rotate with respect to the handle as the implement is pulled away from the hair.

It is to be understood that various combinations of the mounting arrangements and relative rotatability of the member and handle may be employed.

In accordance with other preferred features of the invention, (1) the member may be provided with beveled surfaces at either end, guiding the hair towards the middle of the member as the hair is curled around the body of the member;

(2) the member may be provided with crescent-moon shaped ribs perpendicular to the longitudinal axis of the member that guide the hair as it is curled around the member and as it is disengaged from the member;

(3) mounting arrangements for the handle and hair engaging member may include a shaft provided with a cap at one end, to hold the two parts together while permitting relative rotation;

(4) the handle and member may be provided with facing interlocking mating surfaces;

(5) the handle may be provided with a spring that biases the mating surfaces into an interlocking position and thus prohibits relative rotational movement between the handle and the member; and (6) the handle may be provided with a latch release actuated by the user's thumb that separates the interlocking mating surfaces, thereby allowing the handle to move rotationally with respect to the member and enable the user to selectively hold the member and handle in relative rotational orientation.

Alternatively, in accordance with two specific features of the invention, the implement may be provided with a cap holding the member and handle in a fixed longitudinal relationship; the handle may be provided with a latch activated by the user's thumb that may be provided with teeth which interlock with the mating surface of the member, and thereby enable the user to selectively hold the member and handle in relative rotational orientation; and the latch may be provided with a spring that biases the latch in an interlocking position, and thus prohibit relative rotational movement between the handle and the member.

The advantages of the tangle-free blow dry brush include:

1. The untangling of wet hair;
2. Curling hair, in conjunction with a blow dryer, without the hair getting entangled with the handle;
3. Restraining the hair onto the brush;
4. Easy disengagement of the implement from the hair;
5. Does not kink the hair or cause split ends;
6. Saves time in styling or grooming hair, particularly long or freshly cut wet hair, when the invention is used in conjunction with a blow dryer;
7. Saves electrical energy because a curling iron is not necessary;
8. Increases the drying effect of a blow dryer;
9. Locking and capping arrangements are provided, whereby the member and handle are permitted to freely rotate relative to one another or be held in a selected fixed relative rotational orientation, and remain in relative fixed longitudinal relationship; and
10. Styling and grooming of long or freshly cut wet hair is greatly facilitated.

Other objects, features and advantages of the invention will become readily apparent from a consideration of the following detailed description and from the accompanying drawings.

DETAILED DESCRIPTION

Figure 1:
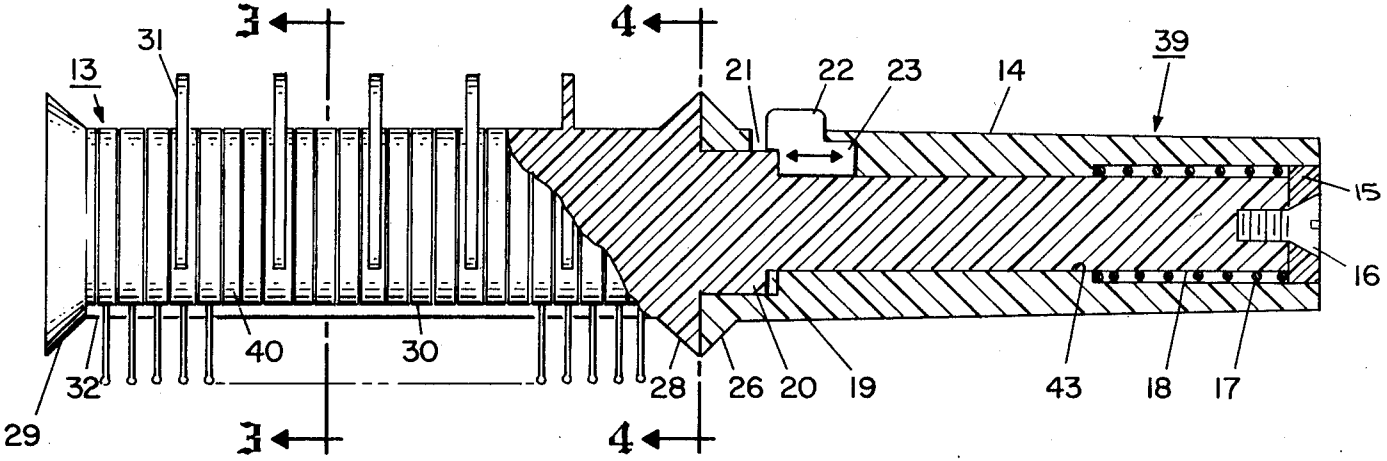
FIG. 1 is a side view of an illustrative embodiment of the present invention in partial cross section of the member showing that the member, shoulder, and shaft are one piece, and a cross section of the handle.

Referring more particularly to the drawings, FIG. 1 shows the preferred embodiment, a tangle-free blow-dry brush 13, with the mid-section partially cut away, and the handle 39 shown in cross section. The partially cut away mid-section shows that the brush and hair grooming and engaging member 30 and mounting means, comprising a shoulder 20, and a shaft 18, are of one piece. More detailed discussion of the handle 39 will follow, but at this point the main features of the implement 13 will be discussed.

As shown in FIG. 1, the member 30 has beveled surface means comprising two opposed beveled flanges 29 and 28 at each end of the member 30, with the flanges angling outwardly from the middle of the member 30. The outwardly angled inner beveled flange 28 not only guides the hair around the member 30, but directs the hair towards the middle of the member 30, thereby preventing tha hair from becoming entangled with the handle 39, or the recess between the handle 39 and the hair engaging member 30. On the other end of the member 30, the outwardly angled outer flange 29 not only guides and directs the hair toward the middle of the member 30, but also prevents the hair from falling off the end of the implement 13.

The ribs 31 between the inner and outer beveled flanges 28 and 29, respectively, are thin crescent-moon shaped, and extend arcuately over the substantially right-cylindrically shaped member 30 on the side opposite to the bristles 27. The planar surfaces of the ribs 31 extend outwardly, substantially perpendicular to the body 40 of the member 30, and extend beyond the imaginery cylindrical surface extending between the outer rims of the two beveled flanges. The ribs 31 guide and separate the hair as it becomes wrapped around the member 30, thus increasing the drying effectiveness of the blow dryer. The ribs 31 are made of heat conducting material, and therefore enhance the drying effect of the blow dryer on the hair, in addition to the curling function of the implement 13. The spaced ribs 31 also inhibit tangling of the hair and therefore provide for easier disengagement of the hair from the member 30.

Figure 2:
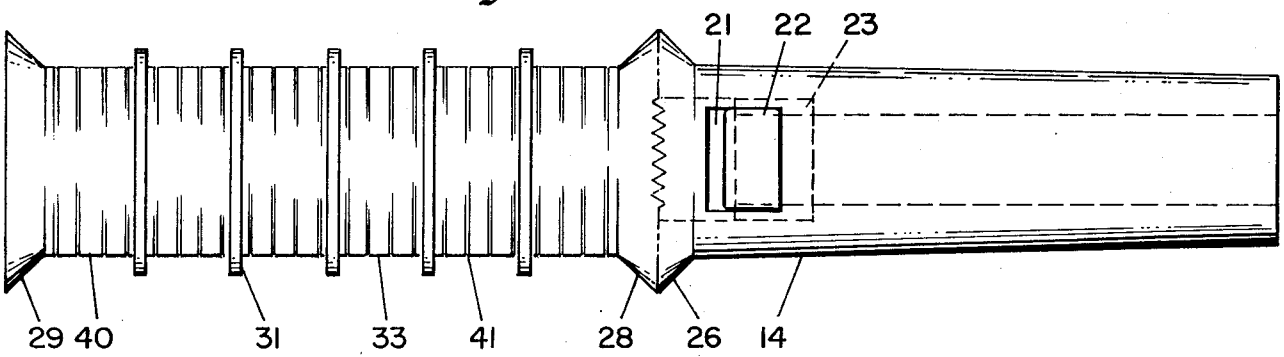
FIG. 2 shows a bird's-eye view of the implement as in FIG. 1.

FIG. 2 shows the body 40 of the substantially right-cylindrically shaped member 30 with grooves 41 along the surface of the body 40. These grooves 41, as an alternative to a smooth surface, help the guiding and untangling objective of the implement 13 as a whole.

The bristles 27 are the main hair engaging element of the implement 13. The bristles 27 are located on the side of the body 40 opposite to ribs 31. The bristles 31, with bulb type ends, extend outwardly from apertures in the bristle holder 32 substantially perpendicular to the body 40. The bristles 27 comprise at least one row, but a plurality of rows are possible extending along the longitudinal length of the body 40, terminating prior to each beveled flange 28 and 29. The bristles 27 are made up of a heat-resistant material. Unlike conventional brush bristles, especially plastic bristles made of low temperature softening plastic, which melt or break down after long use or continued exposure to hot air, these heat resistant bristles 27 are able to withstand extensive exposure to the hot heat of the blow dryer.

The primary purpose of the bristles 27 is to engage the hair in order to wrap it around the member 30. The bristles 27 can also be used like a brush or a comb to untangle the hair and style and groom it. A few rows or even a single row are to be preferred, since more rows increase the possibility of the hair getting entangled with the brush and thus decrease the ease of disengagement of the hair from the implement 13.

The bristles holder 32 has apertures in which the bristles 27 are secured. The bristles holder 32 is mounted in a slot 42 (FIG. 3) on the side of the body 40 of the member 30 opposite to the ribs 31. Alternatively, the bristles 27 may be molded directly onto the member 30.

Figures 3, 4, 5, 6, 7:
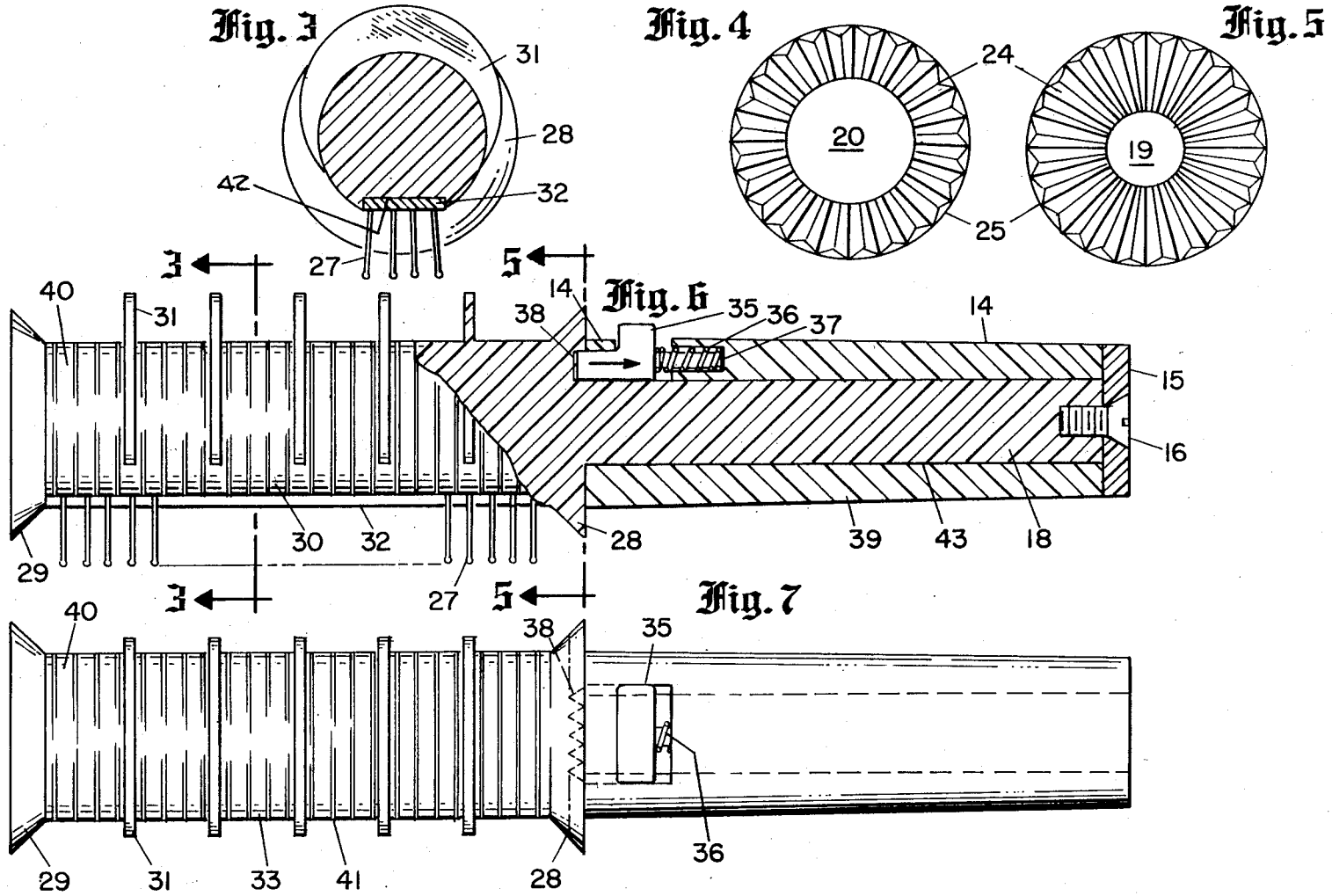
FIG. 3 is a cross-sectional view along the line 3—3 in FIG. 1 and FIG. 6.
FIG. 4 is an axial view along the line 4—4 in FIG. 1.
FIG. 5 is an axial view along the line 5—5 in FIG. 6.
FIG. 6 is a side view of an alternative latching means of the present invention, and with a partially blown away view of the member showing that the member and shaft are one, and a cross-sectional view of the handle.
FIG. 7 shows a bird's-eye view of the implement as in FIG. 6.

As shown in FIG. 1, the member 30 and the handle 39 meet along the line 4—4. FIG. 4 is a cross section along the line 4—4 showing the mating surface 25 located on the flange 28 opposite to its outwardly angled surface. Each of the mating surfaces 25 is covered with a series of ridges 24 radially directed on the plane of the mating surfaces 25, bounded by the shoulder 20 and the outer edge of the inner beveled flange 28.

The handle 39 has a complementary mating surface to interface with the mating surface 25. These surfaces are normally biased to the interlocking position as shown in FIG. 1 by an expansion spring 17 (FIG. 1) exerting a force on the cap 15 and handle structure 14 in opposing directions.

As further illustrated in FIG. 1, the shaft 18 and the shoulder 20 are cylindrical with smooth surfaces. The switch 22 is in contact with the shoulder 20 and rides on the shaft 18. The switch end 23 also rides on the shaft 18 and fits under the structure 14. FIG. 2 shows that the switch end 23 is wider than the switch 22 to keep the switch 22 from dropping out of the handle 39.

Biased in the position as shown in FIG. 1, the gap 21 provides the clearance necessary for disengaging the member 30 from the handle 39. Upon releasing the switch 22, the expansion spring 17 brings the member 30 and handle 39 back together as forementioned.

FIG. 6 shows an alternative embodiment with a different engagement means for prohibiting relative rotational movement between member 30 and handle 39. As illustrated, member 30 and handle 39 remain in a fixed longitudinal relationship. The relative rotational movement is restricted by the latch 35 engaging its teeth 38 with the ridges 24 of the mating surface 25 of the inner beveled flange 28. FIG. 4, taken along the line 5—5 in FIG. 6, shows the ridges 24 extending to the outer rim of the inner beveled flange 28. Alternatively, the ridges 24 need not extend to the outer rim of the inner beveled flange 28, but only to the extent that the ridges 28 will engage the teeth 38 of the latch 35.

As further shown in FIG. 6, the latch 35 is normally biased by a spring 37 wrapped around the latch rod 36 so that the teeth 38 of the latch 35 interlock with the ridges of the mating surface 24. When the latch 35 is pulled away from the mating surface 25, the member 30 and handle 39 are free to rotate on a common longitudinal axis, relative to one another. Latch 35 rides on the shaft 18 and is held in place by handle structure 14.

Although the dimensions are not critical, in one operative embodiment of this invention, the length of the tangle-free blow-dry brush 13 is eight and one-quarter inches, but the length may range from about five inches to thirteen inches; the length of the handle 39 is four inches, but the length may be from about three inches to five inches; the length of the member 30 from flange to flange is about four and one-quarter inches, but the length may range from about two inches to eight inches; the diameter of the body 40 is one and one-quarter inches, but the diameter may range from about one-half inches to two inches; the diameter at the outermost edge of the flange is about one and three-quarter inches, and the diameter may range from about three-quarter inches to three and three-quarter inches; the bristles 27 on the body 40 extend over an arcuate surface about 40 to 50 degrees, but the bristles 27 may be in single row, or may extend over an arcuate surface range from about five degrees to 270 degrees; the ribs 31 mounted on the body 40 extend over an arcuate surface of 135 degrees, but the ribs 31 may extend over an arcuate surface from 90 degrees to 350 degrees; and the angle of the beveled flange surface to the longitudinal axis of the implement is about 45 degrees, but the angle may be from about 40 to 90 degrees.

In closing, it is emphasized that the present invention is not limited to the apparatus shown in the present drawings and disclosed herein. Thus, by way of example and not of limitation, the mounting means, i.e. the shaft 18, could be inserted into the member 30 instead of the handle 39, with the handle 39 and the shaft 18 being one piece. Also, the handle 39 may be tapered to fit the hand of the user or the beveled flange 26 of the handle 39 may be a geometric plinth. As a further alternative, a row or a plurality of rows of comb-like teeth could be used instead of bristles 27. Accordingly, the present invention is not restricted to that shown and described herein.

What is claimed is:

1. A tangle-free grooming and hair-dressing implement for use with a blow dryer, comprising:
   a handle;
   a brush and hair grooming and engaging member;
   said member including:
      a. a densely packed row of heat-resistant bristles extending outward radially from one sector of the member;
      b. surface means for directing hair towards the middle of said member; and
      c. integral outwardly extending flat ribs directed radially and opposite said bristles;
   mounting means for mounting said member for rotation with respect to said handle;
   whereby hair may be untangled and curled over the body of said member without said hair becoming tangled around the brush handle while a blow dryer is directed onto the hair, and the implement may be readily disengaged from the hair by permitting the member to rotate with respect to the handle as the implement is removed from the hair.

2. A tangle-free grooming and hair-dressing implement, as claimed in claim 1, wherein:
   said member is substantially right cylindrically-shaped; and
   said member includes a body which is a base for said bristles.

3. A tangle-free grooming and hair-dressing implement, as claimed in claim 1, wherein:
   a plurality of rows of heat-resistant bristles are mounted on said member, said bristles extending outwardly substantially perpendicular to the longitudinal axis of said member and extending substantially for the length of said member;
   each of said flat ribs also mounted on said member, each rib substantially equal in outward extent to said bristles, extending radially outward substantially perpendicular to the longitudinal axis of said member, extending substantially for the length of said member, said ribs being positioned substantially opposite said plurality of rows of bristles.

4. A tangle-free grooming and hair-dressing implement as claimed in claim 1, wherein:
   said surface means includes beveled surface means; and
   said surface means is located at the handle end and at the outer end of said member for directing hair away from the said handle, and for preventing hair from falling off the outer end, respectively.

5. A tangle-free grooming and hair-dressing implement as claimed in claim 1, wherein:
   said mounting means includes a shaft extending from one of the two relatively rotatable parts into the other.

6. A tangle-free grooming and hair-dressing implement for use with a blow dryer, comprising:

a handle;
a brush and hair grooming member;
said member including;
a. a row of heat-resistant bristles;
b. spaced inner and outer surface means for directing hair towards the center of said member; and
c. outwardly extending thin ribs positioned equal distance from the central axis of said member as said bristles;
whereby hair may be untangled and curled over the body of said member while a blow dryer is directed onto the hair and the implement may be readily disengaged from the hair by rotating the brush as the implement is pulled away from the hair.

7. A tangle-free grooming and hair-dressing implement, as claimed in claim 6, wherein:
said member is substantially right cylindrically-shaped;
said member includes a body which is a base for said bristles and said ribs;
further including a bristle holder means for mounting a plurality of rows of bristles directly opposite said ribs; and
said body including slot means for mounting said bristle holder means.

8. A tangle-free grooming and hair-dressing implement, as claimed in claim 6, wherein:
a plurality of rows of heat-resistant bristles are mounted on said member, extending outwardly substantially perpendicular to the longitudinal axis of said member and extending substantially for the length of said member.

9. A tangle-free grooming and hair-dressing implement, as claimed in claim 6, wherein:
said spaced inner and outer means include beveled surface means for directing hair away from said handle and from the outer end of member, respectively; and
said beveled surface means are angled outwardly from middle of said member, at the ends thereof.

10. A tangle-free grooming and hair-dressing implement, as claimed in claim 6, wherein:
said ribs are substantially crescent-moon shaped and are mounted on the opposite side of said member from said bristles; and
said ribs extend in planes substantially perpendicular to the longitudinal axis of said member;
whereby said ribs guide and untangle hair, conduct heat, and increase blow dryer efficiency.

11. A tangle-free grooming and hair-dressing implement for use with a blow dryer, comprising;
a handle;
a brush and hair grooming and engaging member; said
member including:
a. a row of heat-resistant bristles;
b. spaced inner and outer surface means for directing hair towards the center of said member; and
c. outwardly extending thin ribs positioned equal opposite said bristles;
mounting means for mounting said member for rotation with respect to said handle;
locking means for holding said member and handle in fixed relative rotational orientation with respect to one another;
releasing means for releasing said locking means to permit relative rotation of said handle and member; and
cap means for maintaining said handle and said member in assembled relationship with one-another;
whereby hair may be untangled and curled over the body of said member while a blow dryer is directed over the hair, and the implement may be disengaged from the hair by releasing the member from the handle and permitting it to rotate as the implement is removed from the hair.

12. A tangle-free grooming and hair-dressing implement as claimed in claim 11, wherein:
said member is substantially cylindrically-shaped;
said member includes a body which is a base for said bristles and said ribs; and
said body includes means for mounting said bristles opposite said ribs.

13. A tangle-free grooming and hair-dressing implement as claimed in claim 11, wherein:
a plurality of rows of heat-resistant bristles are mounted on said member, extending outwardly substantially perpendicular to the longitudinal axis of said member and extending substantially for the length of said member;
said bristles extending no further outward from said member than the greatest extension of said ribs.

14. A tangle-free grooming and hair-dressing implement, as claimed in claim 11, wherein:
said spaced inner and outer surface means include beveled surface means for directing hair away from said handle and from the outer end of member, respectively; and
said beveled surface means are angled outwardly from the middle of said member, at the ends thereof.

15. A tangle-free grooming and hair-dressing implement, as claimed in claim 11, wherein:
said ribs are smoothly tapered and are mounted on the opposite side of said member from said bristles; and
said ribs extend in planes substantially perpendicular and equal distance from the longitudinal axis of said member as the extending row of bristles;
whereby, said ribs guide and untangle hair, conduct heat, and increase blow dryer efficiency.

16. A tangle-free grooming and hair-dressing implement, as claimed in claim 11, wherein:
said mounting means includes a shaft extending from one of the two relatively rotatable parts into the other.

17. A tangle-free grooming and hair-dressing implement, as claimed in claim 11, wherein said locking means includes interlocking and mating surface means on said handle and said member.

18. A tangle-free grooming and hair-dressing implement, as claimed in claim 11, wherein:
said locking means and said releasing means include a spring means for biasing the locking means into a locking position, and latch means for actuation by user's thumb for selectively holding said member and handle either (1) locked in a fixed relative orientation with respect to one another, or (2) with said member freely rotatable with respect to said handle.

19. A tangle-free grooming and hair-dressing implement, as claimed in claim 11, wherein:
said releasing means includes a latch with teeth means for interlocking with said member's said mating surface; and latch actuating means for engagement by a user's thumb for selectively holding said member and handle in fixed relative orientation with respect to one another, or with said member freely rotatable with respect to said handle.

20. A tangle-free grooming and hair-dressing implement, as claimed in claim 11, wherein:

said cap means includes a cap at the end of the implement and a screw securing said cap to hold said cap onto said mounting means.

* * * * *